US009103546B2

(12) United States Patent
Almalki

(10) Patent No.: US 9,103,546 B2
(45) Date of Patent: Aug. 11, 2015

(54) HAND HELD DEVICE WITH NON-PERMANENT LED LINE GUIDES, BOOKMARK, AND HAND SUPPORT FEATURES

(71) Applicant: Bader Abdullah Almalki, Mankato, MN (US)

(72) Inventor: Bader Abdullah Almalki, Mankato, MN (US)

( * ) Notice: Subject to any disclaimer, the term of this patent is extended or adjusted under 35 U.S.C. 154(b) by 122 days.

(21) Appl. No.: 14/088,497

(22) Filed: Nov. 25, 2013

(65) Prior Publication Data

US 2015/0146414 A1 May 28, 2015

(51) Int. Cl.

| | |
|---|---|
| ***A47B 19/00*** | (2006.01) |
| ***F21V 33/00*** | (2006.01) |
| ***F21V 23/00*** | (2015.01) |
| ***F21V 14/02*** | (2006.01) |
| ***H05B 33/08*** | (2006.01) |
| *F21Y 101/02* | (2006.01) |

(52) U.S. Cl.

CPC ..... *F21V 33/0048* (2013.01); *F21V 14/025* (2013.01); *F21V 23/003* (2013.01); *H05B 33/0845* (2013.01); *F21Y 2101/02* (2013.01)

(58) Field of Classification Search

CPC .. F21V 14/025; F21V 33/0048; F21V 23/003
USPC ..... 362/98, 249.03, 234; 235/426.42, 235/462.45, 472.01

See application file for complete search history.

(56) References Cited

U.S. PATENT DOCUMENTS

| | | | | |
|---|---|---|---|---|
| 6,142,644 | A * | 11/2000 | Leung | 362/98 |
| 2001/0045460 | A1* | 11/2001 | Reynolds et al. | 235/385 |
| 2004/0206819 | A1* | 10/2004 | Okada et al. | 235/454 |
| 2005/0094385 | A1* | 5/2005 | Lee | 362/98 |
| 2011/0017828 | A1* | 1/2011 | Pine | 235/472.01 |

* cited by examiner

*Primary Examiner* — Elmito Breval
*Assistant Examiner* — Bushara Bushara Dosa

(57) ABSTRACT

A hand held device includes a container body having a column of individually controlled LED lights for use as guide lines for handwriting and for use as a highlighting feature. Processing circuitry is included that stores LED light configurations to be recalled for later use.

5 Claims, 7 Drawing Sheets

| LED LIGHT POSITION | I/O | HEIGHT 0–5 | BRIGHTNESS 0–5 | PAGE |
|---|---|---|---|---|
| 1 | 1 | 3 | 5 | 7 |
| 2 | 1 | 3 | 3 | 7 |
| 3 | 1 | 3 | 5 | 7 |
| 4 | 0 | 3 | 0 | 7 |
| 5 | 1 | 3 | 5 | 7 |
| 6 | 1 | 3 | 3 | 7 |
| 7 | 1 | 3 | 5 | 7 |

| LED LIGHT POSITION | I/O | HEIGHT 0–5 | BRIGHTNESS 0–5 | PAGE |
|---|---|---|---|---|
| 1 | 1 | 0 | 5 | 4 |
| 2 | 1 | 5 | 5 | 4 |
| 3 | 0 | 0 | 0 | 4 |
| 4 | 0 | 0 | 0 | 4 |
| 5 | 0 | 0 | 0 | 4 |
| 6 | 0 | 0 | 0 | 4 |
| 7 | 0 | 0 | 0 | 4 |

HAND HELD DEVICE WITH NON-PERMANENT LED LINE GUIDES, BOOKMARK, AND HAND SUPPORT FEATURES

BACKGROUND

1. Field of the Disclosure

This disclosure relates to a hand held device providing illuminated line guides for the purpose of providing guidelines for hand written text and also provides a bookmark for written text as well as providing a hand rest.

2. Description of the Related Art

The "background" description provided herein is for the purpose of generally presenting the context of the disclosure. Work of the presently named inventor, to the extent it is described in this background section, as well as aspects of the description which may not otherwise quality as prior art at the time of filing, are neither expressly nor impliedly admitted as prior art against the present invention.

People commonly hand write notes, letters, and address envelops using un-lined paper. This can cause the written word to be uneven and give the appearance of unskilled penmanship. Also, when reading manual text, it is easy to lose track of the text line.

SUMMARY

Unlined paper can result hard to read text. This disclosure describes a method and apparatus for making non-permanent lines for the purpose of providing guidelines for hand written text. The hand-held device includes a series of LED lights, (or other light source such as lasers), a leveling system, a tracking system, a computer, and an output system. The hand held device also addresses the need for highlighting text and for electronically storing the page number and line of text the reader chooses to bookmark. In addition, the position of the LED lights can be controllably altered to increase the spacing between lines, to decrease the spacing between lines, and to create a wider beam of light to be used for highlighting written text.

In addition to non-permanents lines, the disclosure describes a mechanism for providing a bookmark and also provides hand support features.

DETAILED DESCRIPTION OF THE EMBODIMENTS

Figure 1:
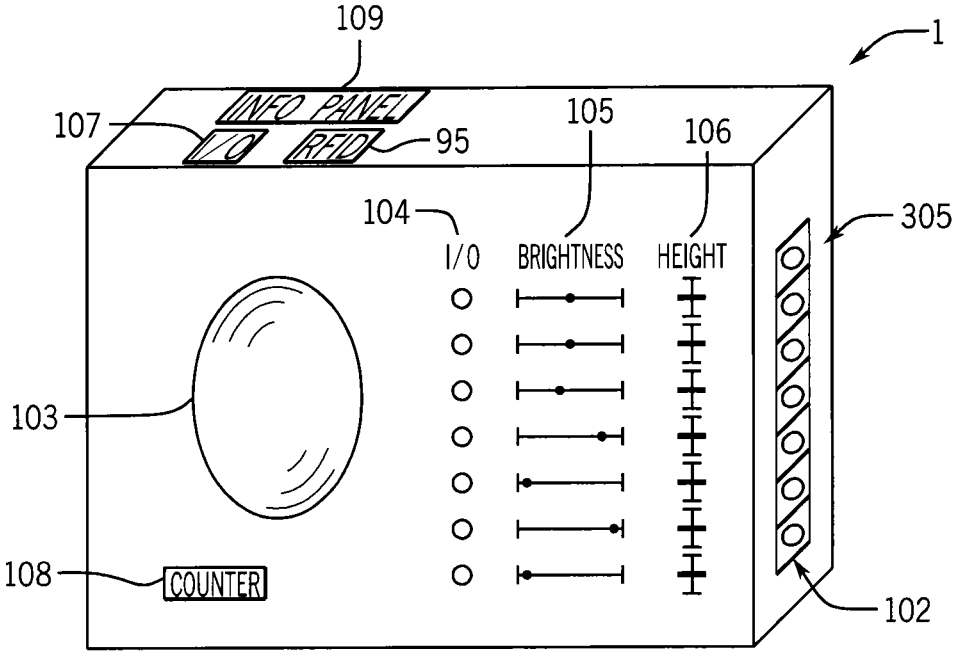
FIG. 1 is a perspective view of a hand held device with non-permanent LED line guides, and bookmark feature.
Figure 2:
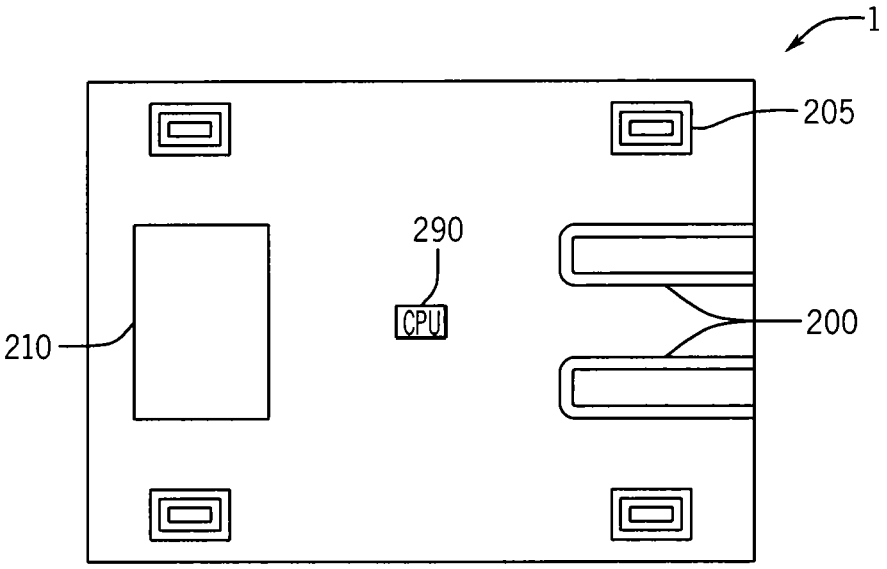
FIG. 2 is a back view of a hand held device with non-permanent LED line guides, and bookmark.

Referring now to the drawings, wherein like reference numerals designate identical or corresponding parts throughout the several views, FIG. 1 is an illustrative view of a of a hand held device 1 with a row of non-permanent LED line guides 102, bookmark capability, hand support feature 103, and an On/Off power switch 107, and a CPU 290 FIG. 2. Although the embodiment describes LED lights, other light sources can be used as well, such as one or more lasers. Each LED line guide 102 has an individual On/Off 104 switch, individual brightness control 105, and individual height adjustment control 106. These individual controls are customizable by the end user based upon their individual needs. If the end user prefers wide spaces between the non-permanent line guides, the LEDs guide lines can be moved to their farthest positions and intermediate light beams can be turned off. If the end user requires a mid-line guide line, a center beam brightness can be dulled to make it less bright than a top and a bottom line guide. If the end user is reading and requires a guide line to keep text in view, two beams can be positioned to create a wider beam used as a highlight feature.

The handheld device 1 is includes of a column of individually controlled LED line guide lights 102, a corresponding column of individual brightness controls 105, a corresponding column of individual On/Off controls 104, a corresponding column of individual height controls 106, and a corresponding column of individual stop guards 305, an information panel 109 and an RFID reader 95. The information panel 109 enables the user to save a customized setting and access previously saved configuration for use.

In addition, a counter 108 can be adjusted to store and indicate a page number and the position of the LED line guides 102 are memorized and together can be used to provide a bookmark.

FIG. 2 is a back view of the handheld device 1 with non-permanent LED line guides, and book mark feature. Two clips 200 are used to attach the handheld device to sheets of paper. These sheets of paper can be loose or in a bound book or magazine. The feet 205 are individually retractable and are controlled by a CPU 290 to provide an automatic leveling feature. Each of the feet 205 are individually controllably adjustable for maximum leveling capability to ensure straight line images are projected onto paper. A battery compartment 210 is accessible from the back of the handheld device.

Figure 3:
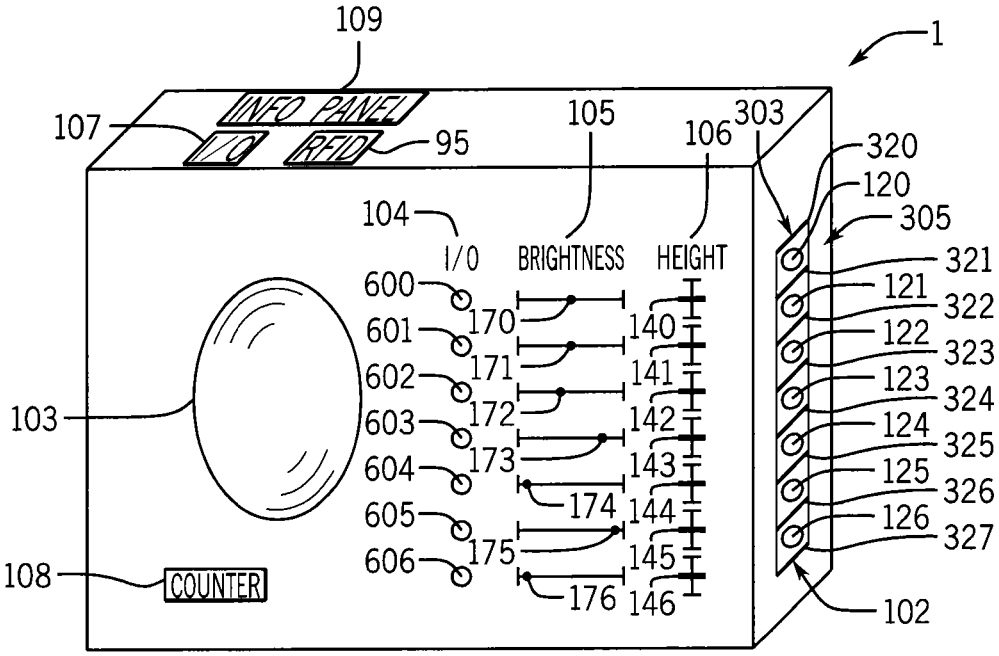
FIG. 3 is a side view of a hand held device with non-permanent LED line guides, configured to project equally spaced non-permanent guide lines.

FIG. 3 is a side view of the hand held device 1 with non-permanent LED line guide tracks 303 positioned between a column of equally spaced stop guards 305. The column of individually controlled LED line guide lights 102 are individually positioned horizontally along the line guide track 303 using the corresponding column of individual height controls 106. FIG. 3 shows the column of individually controlled LED guide lights 102 with individual controlled LED line guide light 120 positioned using a corresponding height adjustment control 140 horizontally positioned equally spaced between a top stop guard 320 and a bottom stop guard 321, individual controlled LED line guide light 121 positioned using a corresponding height adjustment control 141 horizontally positioned equally spaced between a top stop guard 321 and a bottom stop guard 322, individual controlled LED line guide light 122 positioned using a corresponding height adjustment control 142 horizontally positioned equally spaced between a top stop guard 322 and a bottom stop guard 323, individual controlled LED line guide light 123 positioned using a corresponding height adjustment control 143 horizontally positioned equally spaced between a top stop guard 323 and a bottom stop guard 324, individual controlled LED line guide light 124 positioned using a corresponding height adjustment control 144 horizontally positioned equally spaced between a top stop guard 324 and a bottom stop guard 325, individual controlled LED line guide light 125 positioned using a corresponding height adjustment control 145 horizontally positioned equally spaced between a top stop guard 325 and a bottom stop guard 326, and individual controlled LED line guide light 126 positioned using a corresponding height adjustment control 146 horizontally positioned equally spaced between a top stop guard 326 and a bottom stop guard 327, along the line guide track 303.

In this configuration, the hand held device 1 emits equally spaced non-permanent guide lines onto a surface of varying brightness levels. Line guide light 120 has a corresponding individual On/Off control 600 and an individual brightness control 170, line guide light 121 has a corresponding individual On/Off control 601 and an individual brightness control 171, line guide light 122 has a corresponding individual On/Off control 602 and an individual brightness control 172, line guide light 123 has a corresponding individual On/Off control 603 and an individual brightness control 173, line guide light 124 has a corresponding individual On/Off control 604 and an individual brightness control 174, Line guide light 120 has a corresponding individual On/Off control 605 and an individual brightness control 175, Line guide light 120 has a corresponding individual On/Off control 606 and an individual brightness control 176.

In the configuration of FIG. 3, the hand held device 1 emits equally spaced non-permanent guide lines onto a surface of varying brightness levels. The varying brightness levels allow the end user of the hand held device to select the type of line guide desired based on a specific need. In this configuration, LED guide light 120, LED guide light 121, and LED guide light 122 are equally spaced and have medium brightness levels. This configuration can be used to underline specific text to be read, or to generate non-permanent guide lines for handwritten text of the same height. LED guide light 123 is in a low brightness state. LED guide light 124 is in a maximum brightness level, LED guide light 145 is in a minimum brightness level, and LED guide light 126 is in a maximum brightness level. This configuration; a top line guide and a bottom line guide with maximum brightness coupled with a middle line guide light with minimum to enable the user to simulate a midpoint in hand written text for letters that do not go to the top line guide (like the letter 'e'). This configuration can be stored in memory 302 FIG. 10.

The LED line guide tracks 303 that are used to move the LED lights into more than one configuration based upon the need of the end user. The LED lights can be equally positioned for evenly spaced lines guides, or can be customizably spaced along the LED line guide tracks 303 as to the end user's preference. This configuration saved on a (the same or a different) non-transitory electronic storage device and used to store conditions for non-permanent line features.

Figure 4:
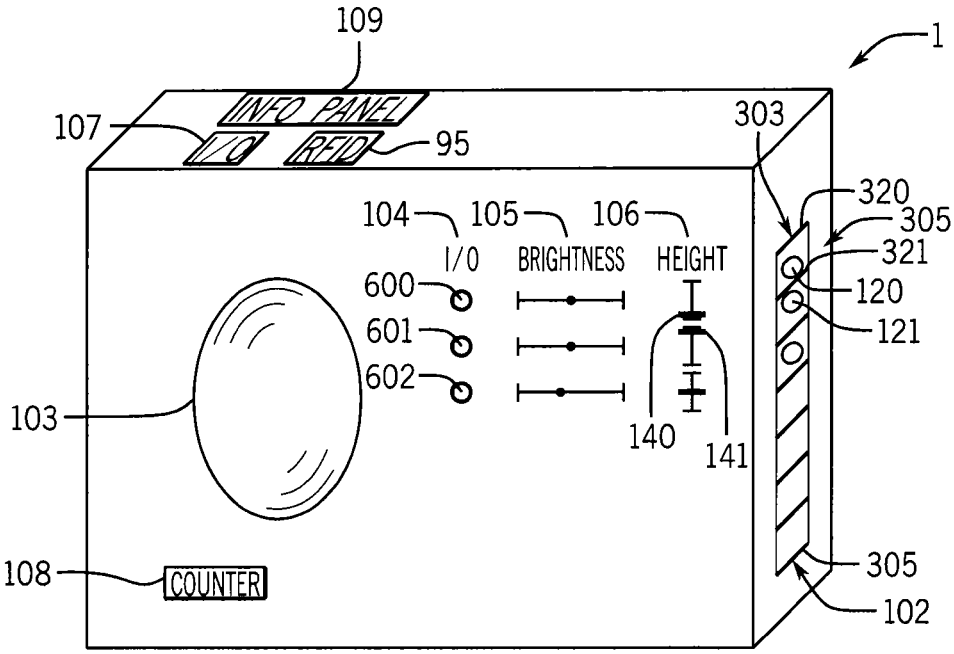
FIG. 4 is a side view of a hand held device with non-permanent LED line guides configured to project a non-permanent highlighter.

FIG. 4 is a side view of another embodiment of the hand held device with non-permanent LED line guides in a highlight feature position. The column of individually controlled LED guide lights 102 are individually positioned along the line guide track 303 and emit a highlight feature light. The individually controlled LED line guide light 120 is manually positioned using a corresponding height adjustment control 140. The guide light 120 can be positioned between a top stop guard 320 along its portion of the line guide track 303 and a bottom stop guard 321. The line guide track 303 has equally spaced stop guards 305 along a length of the line guide track 303. Each individually controlled LED line guide light 102 is able to be manually positioned using a corresponding column of individual height controls 106. FIG. 4 illustrates individual controlled LED line guide light 120 positioned at a bottom stop guard 321 and individual controlled LED line guide light 121 positioned at a topmost position at stop guard 321 along its designated position along track 303.

Line guide light 120 has a corresponding individual On/Off control 600 and an individual brightness control 170, line guide light 121 has a corresponding individual On/Off control 601 and an individual brightness control 171, line guide light 122 has a corresponding individual On/Off control 602 and an individual brightness control 172. Line guide light 120 is in the ON state and is projecting a medium brightness level. Line guide light 121 is in the ON state and is projecting a medium brightness level. The remaining LED guide line lights are in the OFF state. In this configuration the hand held device 1 is configured to non-permanently highlight text. This configuration saved on a (the same or a different) non-transitory electronic storage device and used to store conditions for non-permanent line features. In addition, a counter 108 can be adjusted to store and indicate a page number and the position of the LED line guides 102 are memorized and together can be used to provide a quick reference to the highlighted text.

Figures 5, 6:
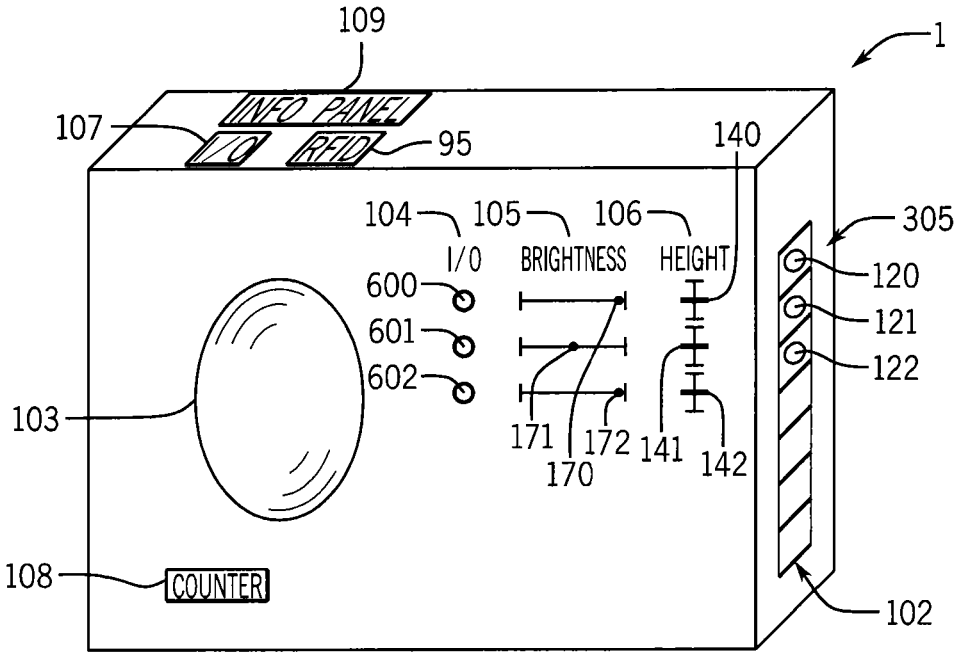
FIG. 5 is a side view of a hand held device with non-permanent LED line guide lights configured to project triple handwriting guide lines.
FIG. 6 is a lookup table for triple guide lines.

FIG. 5 is a side view of another embodiment of the hand held device with non-permanent LED line guides in the ruled line feature position. All LED line guide lights are moved to their respective center position between their respective stop guards 305. A top LED light 120 is powered On by its individual On/Off 600 switch, individual brightness control 170 is in a brightest position, and is positioned to the midpoint of the track using height adjustment control 140. A second LED light 121 is powered On by its individual On/Off 601 switch, individual brightness control 171 is in the mid-brightness position, and is positioned to the midpoint of the track using the height adjustment control 141 creating a dim line guide to be used as the mid-height for text. A third LED light 122 is positioned below the second LED light 121 is powered On by its individual On/Off 602 switch, individual brightness control 172 is in the brightest position, and is positioned to the midpoint of the track using the height adjustment control 547 creating a bottom line guide. This configuration can be used alone to create one set of line guides or this configuration can be continued in the same sequence for the remaining LED lights to create non-permanent line guides for additional text. This configuration can be saved on a (the same or a different) non-transitory electronic storage device and used to store conditions for non-permanent line features.

FIG. 6 shows the contents of a look up table saved on a (the same or a different) non-transitory electronic storage device and used to store conditions for non-permanent line features. The condition for FIG. 5 is for two sets of guide lines for text with a top line and bottom line of the same brightness to identify the top and bottom positions respectively for text and a mid-line guide of a lower brightness to identify the midpoint of text. The first column from the left identifies the specific LED light to be controlled. The second column from the left identifies if the LED light identified in the left column should be On or Off. The third column from the left identifies the vertical position of the LED light. The fourth column from the left identifies the brightness of the LED light, and the fifth column from the left identifies the page number the text associated with the LED light is found.

Figures 7, 8:
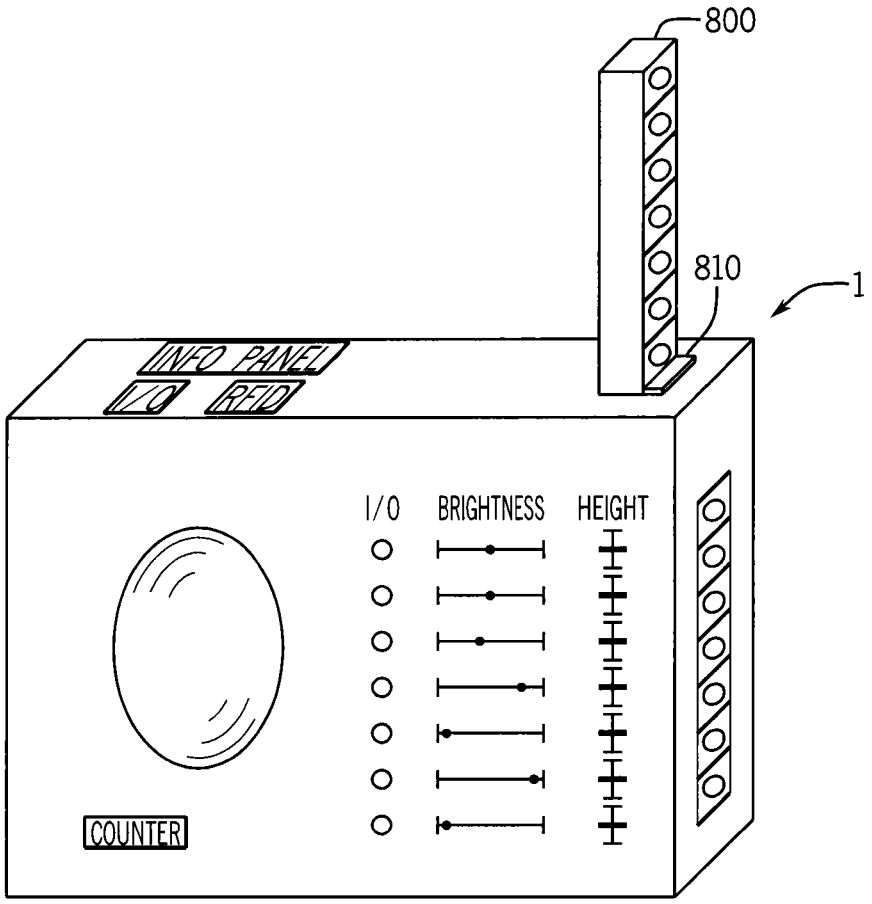
FIG. 7 is a lookup table for conditions of a non-permanent highlight feature.
FIG. 8 is another embodiment of the disclosure having a bank of retractable and extendable LED line guides.

FIG. 7 shows the contents of a look up table saved on a (the same or a different) non-transitory electronic storage device and used to store conditions for non-permanent highlight feature. The condition for FIG. 4 is for two guide line lights to be positioned next to each other with the same brightness for a highlight feature. The first column from the left identifies the specific LED light to be controlled. The second column from the left identifies if the LED light identified in the left column should be On or Off. The third column from the left identifies the vertical position of the LED light. The fourth column from the left identifies the brightness of the LED light, and the fifth column from the left identifies the page number the text associated with the LED light is found. A first and second LED light are in the On position. The first LED light is in the lowest vertical position and the second LED light is in the highest vertical position thus the two LED light beams being positioned close together yielding a single thick beam for highlighting text. The brightness of the first and second LED lights being in the brightest position. The last column identifies the page number of the text that was highlighted. This configuration can be saved on a (the same or a different) non-transitory electronic storage device and used to store conditions for non-permanent line features.

FIG. 8 illustrates another embodiment a set of retractable LED light banks 800 contained within the handheld device with non-permanent LED light guides, and bookmark. The light banks 800 are manually extended to provide additional LED light beams for larger paper or books. These light banks are pushed into a top receiving locking device 810 and are aligned with the original LED lights to form a larger area than the dimension of the hand held device. If the additional LED light beams are not needed, the retractable LED light banks are configured to retract into the handheld device.

Figure 9:
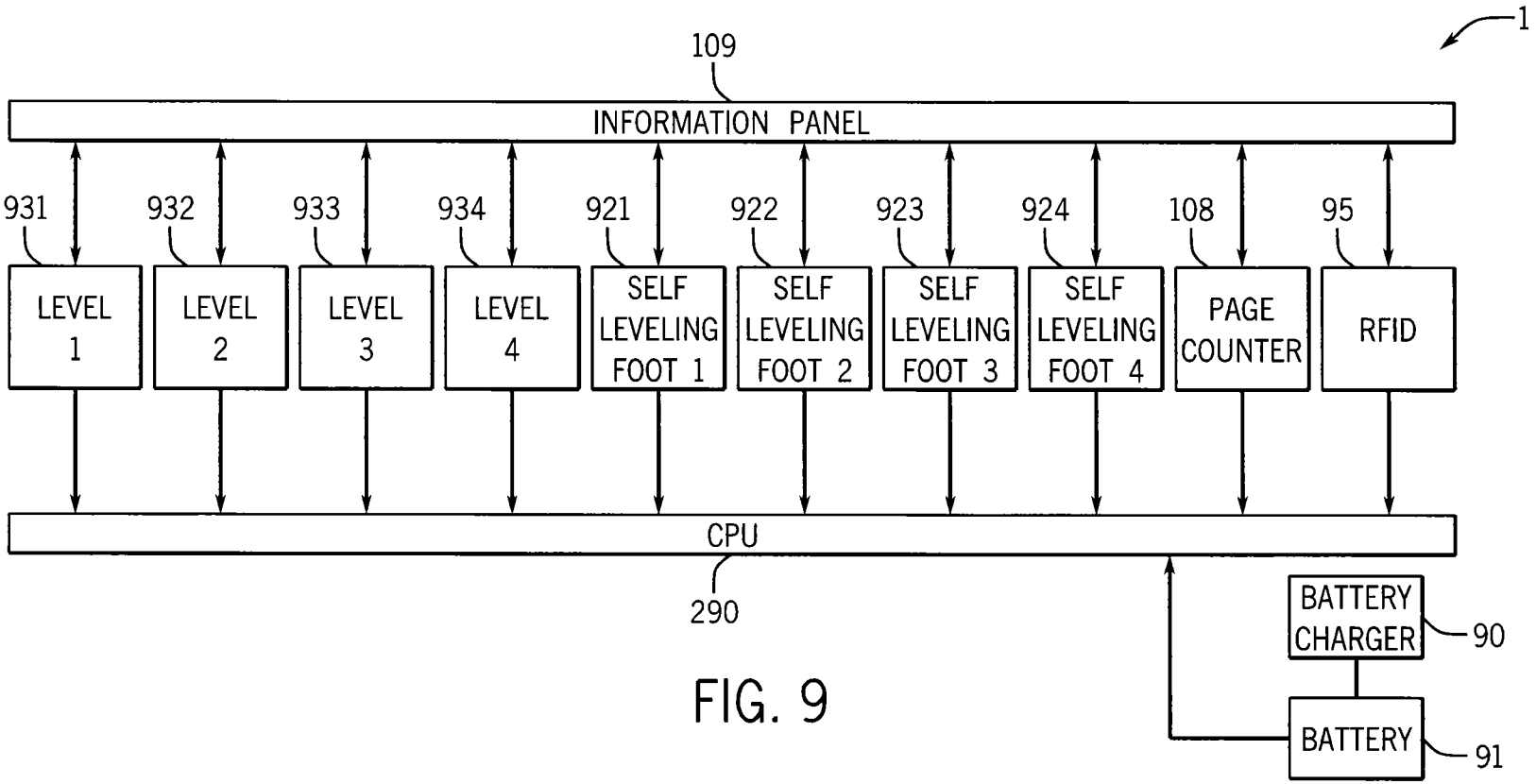
FIG. 9 illustrates a computer system upon which an embodiment of a controller for controlling the information panel may be implemented.

FIG. 9 is a system block diagram of the communication between the hand held device 1, the RFID reader 95, the CPU 290, a first internal level 921, a second internal level 922, a third internal level 923, a fourth internal level 924, a first self-leveling foot 931, a second self-leveling foot 932, a third self-leveling foot 934, and a fourth self-leveling foot 935, and the page counter 108. The first internal level 921 is coupled to the first self-leveling foot 931, the second internal level 922 is coupled to the second self-leveling foot 932, the third internal level 923 is coupled to the third self-leveling foot 933, and the fourth internal level 924 is coupled to the fourth self-leveling foot, the CPU 290, the RFID reader 5, and provides output to the end user. The position of each of the self-leveling feet is measured by the internal level associated with the respective foot and this measurement is provided to the CPU 290 to be used to calculate the height adjustment needed to obtain a level base for the hand held device 1. The level base ensures that the LED line guide lights 102 project straight lines onto the writing surface. The battery 91 with a corresponding battery charger 90 is the power source for the CPU 290.

Figure 10:
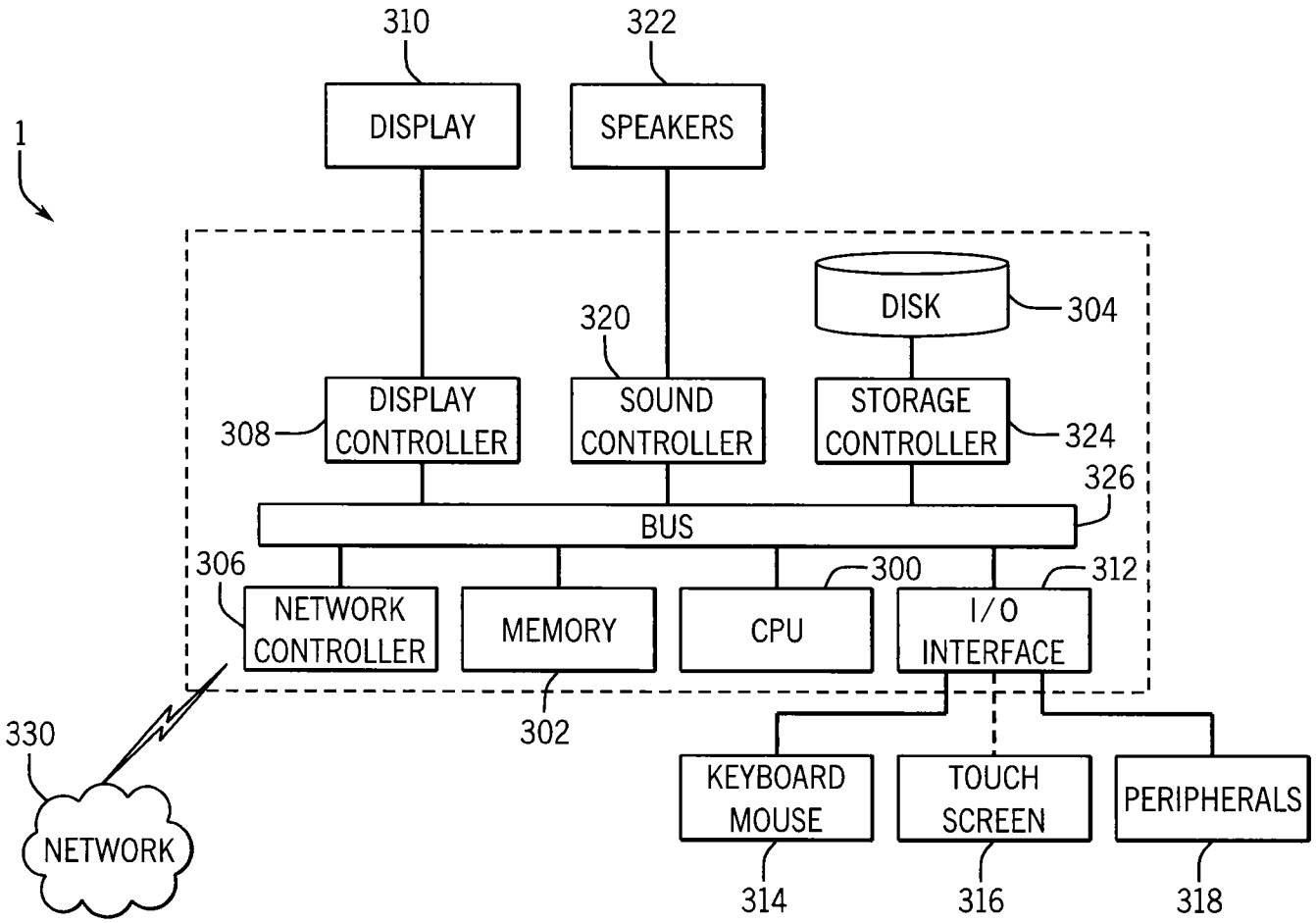
FIG. 10 illustrates a computer system upon which an embodiment of a controller for controlling the information panel may be implemented.

FIG. 10 illustrates a computer system upon which an embodiment of a controller for controlling the information panel may be implemented according to exemplary embodiments is described. The handheld device 1 includes a CPU 300 (an example of processing circuitry) which performs the processes described above. The process data and instructions may be stored in memory 302. These processes and instructions may also be stored on a storage medium disk 304 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the handheld device of FIG. 1 communicates, such as a server or computer.

Further, the claimed advancements may be provided as a utility application, background daemon, or component of an operating system, or combination thereof, executing in conjunction with CPU 300 and an operating system such as Microsoft Windows 7, UNIX, Solaris, LINUX, Apple MAC-OS and other systems known to those skilled in the art.

CPU 300 may be a Xenon or Core processor from Intel of America or an Opteron processor from AMD of America, or may be other processor types that would be recognized by one of ordinary skill in the art. Alternatively, the CPU 300 may be implemented on an FPGA, ASIC, PLD or using discrete logic circuits (all examples of processing circuitry), as one of ordinary skill in the art would recognize. Further, CPU 300 may be implemented as multiple processors cooperatively working in parallel to perform the instructions of the inventive processes described above.

The handheld device 1 also includes a network controller 306, such as an Intel Ethernet PRO network interface card from Intel Corporation of America, for interfacing with network 330. As can be appreciated, the network 330 can be a public network, such as the Internet, or a private network such as an LAN or WAN network, or any combination thereof and can also include PSTN or ISDN sub-networks. The network XX can also be wired, such as an Ethernet network, or can be wireless such as a cellular network including EDGE, 3G and 4G wireless cellular systems. The wireless network can also be WiFi, Bluetooth, or any other wireless form of communication that is known.

The handheld device 1 further includes a display controller 308, such as a NVIDIA GeForce GTX or Quadro graphics adaptor from NVIDIA Corporation of America for interfacing with display X10, such as a Hewlett Packard HPL2445w LCD monitor. A general purpose I/O interface 312 interfaces with a keyboard and/or mouse 314 as well as a touch screen panel 316 on or separate from display 310. General purpose I/O interface also connects to a variety of peripherals 318 including printers and scanners, such as an OfficeJet or DeskJet from Hewlett Packard.

A sound controller 320 is also provided in the [device], such as Sound Blaster X-Fi Titanium from Creative, to interface with speakers/microphone 322 thereby providing sounds and/or music. The speakers/microphone 322 can also be used to accept dictated words as commands for controlling the handheld device 1 or for providing location and/or property information with respect to the target property.

The general purpose storage controller 324 connects the storage medium disk 304 with communication bus 326, which may be an ISA, EISA, VESA, PCI, or similar, for interconnecting all of the components of the [device]. A description of the general features and functionality of the display 310, keyboard and/or mouse 314, as well as the display controller 308, storage controller 324, network controller 306, sound controller 320, and general purpose I/O interface 312 is omitted herein for brevity as these features are known.

Figure 11:
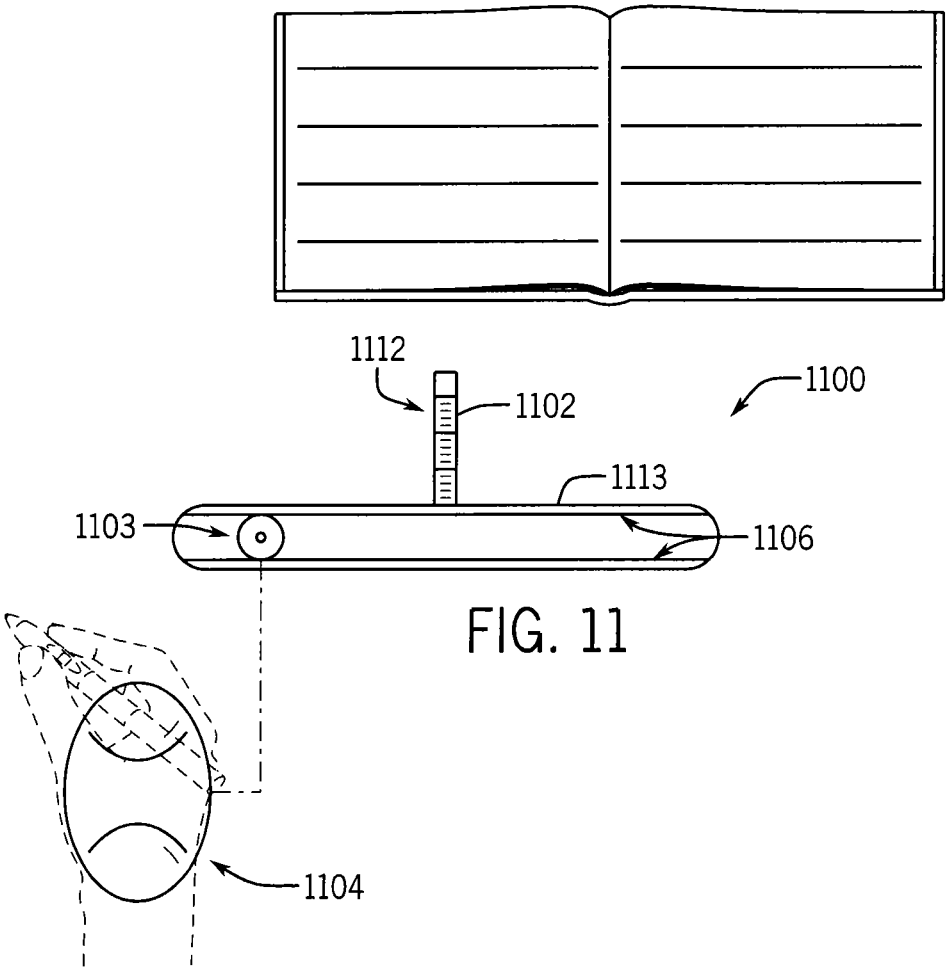
FIG. 11 illustrates another embodiment of this disclosure having a two piece hand held support system.

FIG. 11 illustrates an embodiment of an optional auxilliary two-piece handheld support system 1100 having a stem 1102 for insertion between pages of a book to stabilize the two-piece hand held support system 1100 and having equally spaced incremental markings 1112. A track 1106 is configured to support a slidable housing 1103. The slidable housing 1103 moves horizontally across the two-piece hand support system 1100 and is configured to receive a hand rest 1104. The topside straight edge 1113 can be used in conjunction with the equally spaced incremental markings 1112, and the slidable housing 1103, to manually create horizontal lines on a page for handwritten text.

Figure 12:
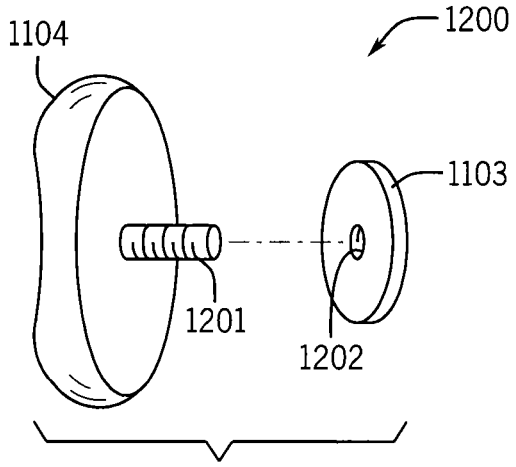
FIG. 12 illustrates a detachable/attachable hand rest configuration.

FIG. 12 is an illustration of the attachment system 1200 between the hand rest 1104 and slidable housing 1103. The hand rest 1104 has a threaded receiver 1201 configured to receive a receptacle 1202 of a housing 1103 for a hand rest 1104. The hand rest is not restricted to a circular shape.

I claim:

1. A hand held device with non-permanent LED line guides comprising:

a container body that contains a column of individually controlled LED lights positioned to produce a series of parallel illuminated lines on a writing surface, a plurality of individual On/Off controls that selectably control power to the column of individually controlled LED lights, a plurality of individual brightness controls that selectably control brightness to the column of individually controlled LED lights, a plurality of individual height adjustment controls that selectably control a vertical height position of the column of individually controlled LED lights, a column of equally spaced stop guards set into a line guide track of the container body along the column of individually controlled LED lights so as to confine the individual height adjustments to a predetermined spacing, a counter configured to receive as input a page number of a document that includes the writing surface;

at least two clips disposed on a backside of the container body, and configured to be inserted between pages of the document, and securely fasten the handheld device to the document, a first self-leveling foot, a second self-leveling foot, and a third self-leveling foot, each disposed on a supporting surface of said container body, and;

processing circuitry configured to receive a height measurement output signal, and determine a dynamic height adjustments that is applied to the first self-leveling foot, the second self-leveling foot, and the third self-leveling foot so as to level the container body with respect to the writing surface, and generate an audio alert signal when the level adjustment exceeds a predetermined threshold height, a non-transitory storage device that has stored therein an indication of the predetermined height adjustment, said indication of the predetermined height adjustment corresponding to a surface on which the hand held device is mounted; and an information panel that receives from the processing circuitry an indication of a total height adjustment and provides a visual display of the total height adjustment.

2. The hand held device of claim 1, wherein the processing circuitry is configured to receive a power output signal for the plurality of individual power controls, a brightness output signal for the plurality of individual brightness controls, and a height measurement output signal for the plurality of individual height adjustment controls, and store in the storage device the power output signal, the brightness output signal, and the height measurement output signal based on the user input.

3. The hand held device of claim 2, further comprising:

an RFID reader configured to read RFID tags of tagged items placed near the hand held device, the RFID reader providing tag information to the processing circuitry for the tagged items.

4. The hand held device of claim 3 wherein each of the RFID tags are associated with the power output signal for the plurality of individual power controls, the brightness output signal for the plurality of individual brightness controls, the height measurement output signal for the plurality of individual height adjustment controls, and page numbers to which the RFID tags are affixed, and the processing circuitry being configured to keep track of the power output signal for the plurality of individual power controls, the brightness output signal for the plurality of individual brightness controls, the height measurement output signal for the plurality of individual height adjustment controls, and the page number to be recalled by the hand held device.

5. The handheld device of claim 4 further comprising a hand support device including a rigid container body, a topside of the rigid container body being a straight edge;

a stem having equally spaced incremental markings, a track, a slidable housing configured to move horizontally along the track, and an attachable/detachable hand rest, wherein the slidable housing is configured to receive the attachable/detachable hand rest.

* * * * *